US009945167B2

(12) United States Patent
Svara et al.

(10) Patent No.: US 9,945,167 B2
(45) Date of Patent: Apr. 17, 2018

(54) MOVEMENT CONTROL DEVICES

(71) Applicant: Titus d.o.o. Dekani, Dekani (SI)

(72) Inventors: Valter Svara, Izola (SI); Danijel Kozlovic, Dekani (SI)

(73) Assignee: Titus d.o.o. Dekani, Dekani (SI)

( * ) Notice: Subject to any disclaimer, the term of this patent is extended or adjusted under 35 U.S.C. 154(b) by 0 days.

(21) Appl. No.: 15/319,862

(22) PCT Filed: Jun. 22, 2015

(86) PCT No.: PCT/EP2015/063989

§ 371 (c)(1),
(2) Date: Dec. 19, 2016

(87) PCT Pub. No.: WO2015/193509

PCT Pub. Date: Dec. 23, 2015

(65) Prior Publication Data

US 2017/0130501 A1 May 11, 2017

(30) Foreign Application Priority Data

Jun. 20, 2014 (GB) ..... 1411062.1

(51) Int. Cl.

| | |
|---|---|
| ***E05F 3/00*** | (2006.01) |
| ***E05F 1/16*** | (2006.01) |
| ***E05F 5/00*** | (2017.01) |

(52) U.S. Cl.

CPC ..... *E05F 3/00* (2013.01); *E05F 1/16* (2013.01); *E05F 5/003* (2013.01); *E05Y 2900/132* (2013.01)

(58) Field of Classification Search

CPC ..... E05F 5/003; E05F 5/05; E05F 1/08; E05F 1/1091; E05F 1/16; E05F 3/00; E05F 3/02; E05F 3/04; E05F 3/18; E05F 3/227; E05F 3/22; E05F 3/10; E05F 3/108; E05F 3/224; E05F 5/02; E05Y 2800/24; E05Y 2800/21; E05Y 2201/64; E05Y 2201/644; E05Y 2201/264; E05Y 2201/41; E05Y 2201/412;

(Continued)

(56) References Cited

U.S. PATENT DOCUMENTS

| | | | | |
|---|---|---|---|---|
| 6,848,759 | B2 * | 2/2005 | Doornbos | E05F 1/16 16/64 |
| 7,743,464 | B2 * | 6/2010 | Tomioka | E05F 3/102 16/49 |

(Continued)

FOREIGN PATENT DOCUMENTS

| | | |
|---|---|---|
| JP | 2011127276 A | 6/2011 |
| JP | 2012225054 A | 11/2012 |

*Primary Examiner* — Chuck Mah
(74) *Attorney, Agent, or Firm* — Alan D. Kamrath; Kamrath IP Lawfirm, P.A.

(57) ABSTRACT

A device is provided for controlling the closing movement of a sliding door. The device comprises a housing (10) containing a spring (11) which is actuable to provide a pulling force to the closing movement of the door. The housing (10) also contains a damper (12) which is actuable to impart a damped resistive force to the closing movement of the door. Incorporated within the device is a gearing mechanism for converting the rate of the closing movement of the door into two or more rates of actuation of the damper over at least part of the door's travel.

12 Claims, 1 Drawing Sheet

(58) Field of Classification Search
CPC ..... E05Y 2201/47; E05Y 2201/21; E05Y 2201/488; E05Y 2900/132; E05Y 2900/142; E05Y 2900/14; E05Y 2201/232; E05Y 2201/426; E05Y 2201/638; E05Y 2201/688; E05Y 2800/11; Y10T 16/27; Y10T 16/56; Y10T 16/61; Y10T 16/593; Y10T 16/276; Y10T 16/281; Y10T 16/379; E05D 15/00; E05D 15/06; E05D 15/12; A47B 88/047; A47B 88/12; A47B 88/14; A47B 2210/0091
See application file for complete search history.

(56) References Cited

U.S. PATENT DOCUMENTS 8,793,839 B2 * 8/2014 Iwaki ..... E05F 1/16 16/49
8,806,719 B2 * 8/2014 Kleeman ..... A47L 15/4261 16/286
2002/0096405 A1 * 7/2002 Gasser ..... A47B 88/467 188/82.1
2005/0218759 A1 * 10/2005 Kobayashi ..... A47B 88/467 312/331
2006/0016279 A1 * 1/2006 Sato ..... E05F 1/16 74/89.17
2007/0114896 A1 5/2007 Orita
2010/0031468 A1 2/2010 Tomiji et al.
2010/0071154 A1 * 3/2010 Bortoluzzi ..... E05F 1/16 16/85
2011/0203075 A1 * 8/2011 Iwaki ..... E05F 11/08 16/49
2011/0203183 A1 * 8/2011 Iwaki ..... E05F 5/003 49/358
2011/0308164 A1 * 12/2011 Terasaki ..... B61D 19/026 49/360
2013/0091665 A1 * 4/2013 Tsai ..... E05F 3/18 16/49
2013/0219657 A1 * 8/2013 Iwaki ..... E05F 1/16 16/64
2014/0026357 A1 * 1/2014 Zimmer ..... E05F 1/16 16/72
2014/0109343 A1 * 4/2014 Chang ..... E05F 5/003 16/49

* cited by examiner

MOVEMENT CONTROL DEVICES

BRIEF SUMMARY OF THE INVENTION

This invention relates to movement control devices and in particular, though not exclusively, to damped movement control devices for use with sliding doors.

The invention provides a device for controlling movement of a first member relative to a second member, said device comprising damping means actuable by movement of said first member in a first direction to impart a damped resistive force to the first member in opposition to its movement in said first direction, said device further comprising gearing means for converting the rate of movement of the first member in said first direction into two or more rates of actuation of the damping means over at least part of the travel of the first member.

DESCRIPTION OF THE DRAWINGS

By way of example, embodiments of the invention will now be described with reference to the accompanying drawings, in which.

DETAILED DESCRIPTION

Figure 1:
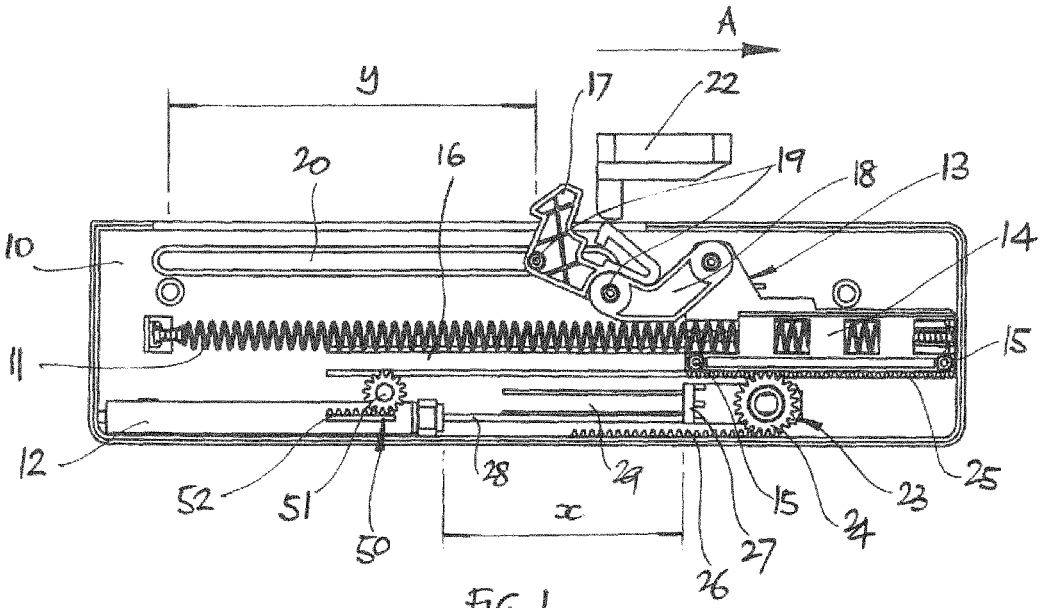
FIGS. 1 and 2 show an embodiment of movement control device according to the invention with its actuator assembly in respective end positions.

The form of movement control device seen in FIG. 1 is designed to impart a damped force to assist the closing movement of a sliding door. The device comprises a housing 10 in which are mounted a tension spring 11 and a linear piston and cylinder type damper 12. The spring 11 provides the force to the door and the damper 12 provides the damping. The spring 11 and damper 12 are both connected to an actuator assembly 13 which is mounted for movement with respect to the housing 10.

The actuator assembly 13 comprises a carriage 14 which is constrained to move linearly relative to the housing 10, with pairs of rollers 15 engaging in opposing tracks 16 to guide its movement. One end of the spring 11 is anchored to the carriage 14, with the other end being anchored to the housing 10.

Figure 2:
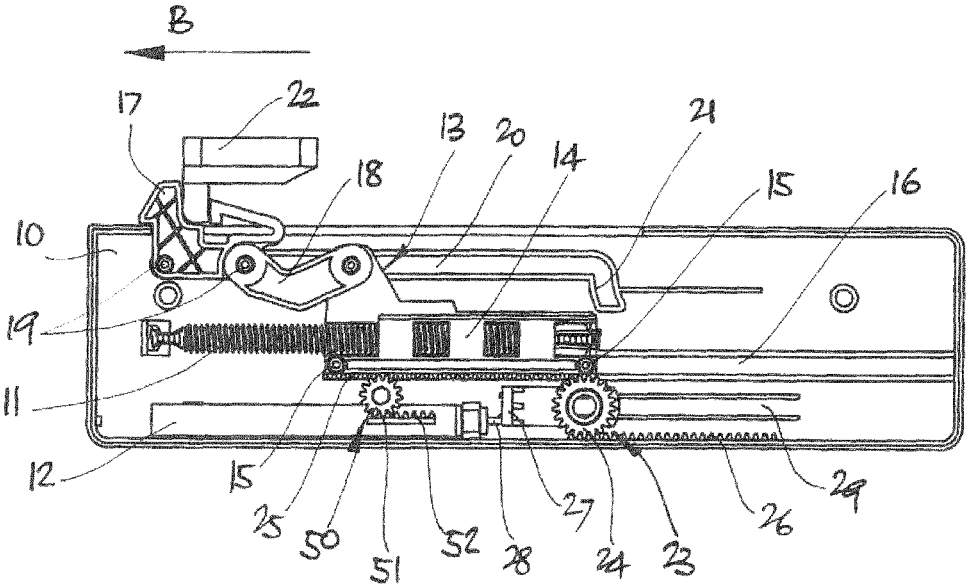

The actuator assembly 13 further comprises a trigger 17 which is pivotally mounted to the carriage 14 via a link 18. The trigger 17 has a pair of pins 19 which are slidably engaged in an elongate slot 20 in the housing 10. The slot 20 is angled at one end so as to provide a stop surface 21 for one of the pins 19 (seen in FIG. 2). This enables the trigger 17 to pivot into a latched position where it holds the actuator assembly 13 against the pulling force of the spring 11. This is the position seen in FIG. 2 and is the condition that the device will be in when the door is open.

The device is designed to be mountable to a door frame so that a catch 22 on the door is engagable with the trigger 17. The device is mounted on the door frame so that the direction of movement of the actuator assembly 13 is aligned parallel with the direction of movement of the sliding door. In this case, the housing 10 is designed to be mounted on the door frame above the door, with the damper 12 and trigger 17 lying in a plane at right angles to the plane of the door. However, other configurations are of course possible.

In operation, the catch 22 on the door engages with the trigger 17 when the door is opened, setting the trigger in its latched position and holding the actuator assembly 13 in the end position seen in FIG. 1. The direction of opening movement of the door is shown by arrow A in FIG. 1. When the door is moved towards its closed position (as shown by arrow B in FIG. 2), the catch 22 re-engages with the trigger 17, pivotting it out of its latched position and allowing the actuator assembly 13 to be pulled towards its other end position under the tensile force of the spring 11. The other end position is that seen in FIG. 2. As the spring 11 pulls the actuator assembly 13 in this manner, so also a pulling force is transmitted to the closing movement of the door, via the engagement of the trigger 17 with the catch 22. This is the working stroke of the device.

The actuator assembly 13 is linked to the damper 12 via a gearing mechanism 23. The mechanism 23 comprises a pinion 24 which is sandwiched between and in toothed engagement with a first rack 25 on the carriage 14 and a second rack 26 arranged in parallel on the housing 10. Both racks 25 and 26 have the same pitch as the pinion 24. The pinion 24 is rotatably mounted on a slider 27, which is movable relative to the housing 10, with its movement being guided by a track 29.

The mechanism 23 may be provided with a pair of pinions 24 instead of the one shown here. The two pinions would both be in engagement with the racks 25 and 26, and would both be mounted on the slider 27, but arranged to be rotatable independently of each other. The arrangement would mean that the forces experienced by the mechanism would be transmitted via two pinions, rather than just one, which would make the mechanism more robust and hence better able to handle larger forces, eg from heavy sliding doors.

The slider 27 engages the free end of the piston rod 28 of the damper 12. The arrangement means that the slider 27 is constrained to move when the actuator assembly 13 moves, through the interengagement of the pinion 24 and the two racks 25 and 26. In particular, when the actuator assembly 13 moves in the direction of the closing movement of the door (arrow B), the slider 27 is caused to push the piston rod 28 into the cylinder of the damper 12, thus causing its compression. Thus, the closing movement of the door is both assisted by the pulling action of the spring 11 and also resisted by the damping action of the damper 12 in the working stroke of the device.

The slider 27 here is connected to the free end of the piston rod 28 of the damper 12. In the alternative, the slider could be arranged simply to abuttingly engage the end of the piston rod. In this case, the piston rod would preferably be biassed towards its extended position, conveniently by means of a compression spring within the damper.

It is to be noted that the gearing mechanism 23 here creates a differential between the movements of the actuator assembly 13 and the slider 27. In particular, the slider 27 is constrained to travel over a shorter distance (shown as x in FIG. 1) than the actuator assembly 13 (shown as y in FIG. 1) as the actuator assembly moves between its end positions. This is intrinsic to the nature of the arrangement, where one of the racks (26) is fixed, whereas the other rack (25) and the pinion (24) are movable. The difference in travel means that the damper 12 is effectively being compressed at a slower rate than the rate of movement of the closing door. Since the damping force produced by a damper is proportional to the rate at which it is compressed, this means that the damping effect created by this arrangement will be less than if the damper were to be linked directly to the movement of the door. When a damper is subjected to too high a rate of compression, for example as might occur when a door is slammed, it will tend to compress very little, if at all, with the result that the door may simply rebound off it. The differential movement created by the gearing mechanism in the device described above helps to guard against this possibility.

Herein addition to the gearing mechanism 23, the device includes a second gearing mechanism 50. The second gearing mechanism 50 comprises a pinion 51 which is rotatably mounted in a fixed position on the housing 10. The pinion 51 is engagable by the rack 25 on the carriage 14 and by a rack 52 arranged in parallel on the cylinder of the damper 12. The pinion 51 has the same pitch as the pinion 24 of the first gearing mechanism 23, but fewer teeth. The effect of the second gearing mechanism 50 is to introduce a second, higher rate of damping towards the end of the closing movement of the door. The operation is as follows:

When the door is open, the device will be in the condition seen in FIG. 1, with the trigger 17 in its latched position, holding the actuator assembly 13 in its end position. As the door closes, the catch 22 engages the trigger 17, causing it to pivot and unlatch, thereby freeing the actuator assembly 13 for movement. The spring 11 now starts to pull the actuator assembly 13 towards its other end position (in the direction of the arrow B), pulling the door with it, through the engagement of the catch 22 with the trigger 17. In this initial movement, the first gearing mechanism 23 operates to cause compression of the damper 12 at a rate which is less than the rate of movement of actuator assembly 13.

As the actuator assembly 13 nears its other end position, the track 25 on the carriage 14 engages with the pinion 51 of the second gearing mechanism 50. Continued movement of the carriage 14 causes the pinion 51 to rotate, which in turn causes the cylinder of the damper 12 to move, through the engagement of the pinion 51 with the rack 52 on the cylinder. This movement of the cylinder is in the opposite direction to the movement of its piston rod 28, meaning that the damper 12 is now effectively being compressed from both ends, ie at a greater rate than before. The greater rate of compression of the damper 12 means that it will produce a greater degree of damped resistance.

Thus, it will be seen that the device is able to provide a two stage damping effect: lower damped resistance over the initial travel and higher damped resistance over the final travel. An advantage of this arrangement is that the device can be tailored to produce relatively "soft" damping, ie low resistive force, at the start of the stroke, which helps to avoid the problem of rebound, whilst producing relatively "hard" damping, ie high resistive force, towards the end of the stroke, which enables the device to absorb even quite high forces.

It will be appreciated that the two gearing mechanisms can be tailored to produce different damping characteristics. For example, adjusting the number of teeth on the pinion 24 will vary the rate of movement of the slider 27 in relation to the rate of movement of the actuator assembly 13, ie the x/y ratio. Also, adjusting the number of teeth on the pinion 51 relative to the number of teeth on the pinion 24 will vary the rate of movement of the cylinder of the damper 12 relative to the rate of movement of the actuator assembly 13, thus affecting the rate of the second stage damping resistance. In addition, it would of course be possible to provide for three or even more damping stages over the course of the working stroke of the device, each potentially offering different damping characteristics It will also be appreciated that whilst the gearing mechanisms described above comprise rack and pinion arrangements, it would be possible to configure one or both of these instead or additionally by the use of gear trains, ie a series of two or more meshing gear wheels. Also, whilst the preferred form of damping device is a linear piston and cylinder type damper, it would be possible to use instead or additionally a rotary shear type damper.

The invention claimed is:

1. A device for controlling movement of a first member relative to a second member, said device comprising:

linearly actuable damping means operable by movement of said first member in a first direction to impart a damped resistive force to the first member in opposition to its movement in said first direction; and gearing means for converting movement of the first member in said first direction into operation of the damping means, wherein the gearing means includes a first pinion in engagement with first and second racks, with said first rack being in a fixed position relative to the second member, and the second rack and the first pinion being linearly displaceable relative to said second member, and wherein the gearing means is operable to produce a lesser rate of linear actuation of the linear damping means over an initial portion of travel of the first member in said first direction and a greater rate of linear actuation of the linear damping means over a subsequent portion of travel of the first member in said first direction.

2. A device as claimed in claim 1 wherein the damping means comprises a linear piston and cylinder type damper.

3. A device as claimed in claim 1 wherein a second gearing means including a second pinion and the second rack is operable to produce a lesser rate of actuation of the damping means over an initial portion of travel of the first member and a greater rate of actuation of the damping means over a subsequent portion of the travel of the first member.

4. A device as claimed in claim 3 wherein the gearing means includes a further pinion engagable by one of the first and second racks, and a third rack engagable by said further pinion.

5. A device as claimed in claim 4 wherein the further pinion is engagable by the second rack.

6. A device as claimed in claim 4 wherein the two pinions have different numbers of teeth.

7. A device as claimed in claim 4 wherein the second rack is mounted to a carriage constrained to move linearly relative to a housing of the device, and the device further comprises biasing means for imparting a spring force to the first member in said first direction, the biasing means anchored at one end to the housing and at another end to the carriage.

8. A device as claimed in claim 7 wherein the biasing means and damping means are arranged to act on the first member via actuating means.

9. A device as claimed in claim 8 wherein the second rack is mounted on the carriage of said actuating means.

10. A device as claimed in claim 9 wherein the actuating means is mounted in the housing and the fixed rack is mounted to or formed as part of the housing.

11. A device as claimed in claim 8 wherein the actuating means is mounted in the housing and the further pinion is rotatably mounted to the housing in a fixed position.

12. A device as claimed in claim 11 wherein the third rack is mounted on or formed as part of said damping means.

* * * * *